US006077071A

United States Patent [19]

Yeh

[11] Patent Number: 6,077,071

[45] Date of Patent: Jun. 20, 2000

[54] SAFETY APPARATUS OF BARBECUE LIGHTER

[76] Inventor: Chun Ching Yeh, 21042 E. Arrow Hwy #5, Covina, Calif. 91724

[21] Appl. No.: 09/449,842

[22] Filed: Nov. 26, 1999

[51] Int. Cl.[7] ..... F23D 11/36

[52] U.S. Cl. ..... 431/153; 437/255

[58] Field of Search ..... 431/153, 255

[56] References Cited

U.S. PATENT DOCUMENTS

| | | | |
|---|---|---|---|
| 5,228,849 | 7/1993 | Frigiere | 431/153 |
| 5,885,069 | 3/1999 | Rogelet | 431/255 |
| 5,971,751 | 10/1999 | Lee | 431/255 |

*Primary Examiner*—Carroll Dority

*Attorney, Agent, or Firm*—Raymond Y. Chan; David and Raymond

[57] ABSTRACT

A safety apparatus of a barbecue lighter includes a resistance unit, which is disposes in the trigger cavity of the casing, providing an additional resistance for press the ignition trigger; and a resilient element, which is coaxially attached to the resistance unit, urging and retaining the ignition trigger in an upper normal position. Therefore, the resistance means resists the depressing force applied on the ignition trigger by an under age child which the under age child has limited physical capability while an adult is capable of pressing the ignition trigger easily.

15 Claims, 4 Drawing Sheets

SAFETY APPARATUS OF BARBECUE LIGHTER

BACKGROUND OF THE PRESENT INVENTION

1. Field of Invention

The present invention relates to a barbecue lighter, and more particularly to a safety apparatus of a barbecue lighter for preventing under age children from the usage of the barbecue lighter.

2. Description of Related Arts

Most accidental fire cases today, many were started by the ignorant usage of lighter, especially a barbecue lighter used at home such as pilot light for stoves or outdoor activities such as fireplaces or camping. Those accidental fires are caused by ignorance of human mistakes, especially among our young children. So it is now required a safety apparatus for preventing under age children from the usage of the lighter and adults from accidentally or unintentionally igniting the lighter.

Conventional barbecue lighter comprises a safety lock for preventing the ignition trigger of the lighter from accidentally being depressed thereby causing an unintended ejection. To ignite the lighter, user must unlock the safety lock by pressing a safety button or switching the lock aside. User may repeat the step of unlocks the safety lock many times until he or she ignites a fire in certain condition. Therefore, such incorporating mechanism may lead to different results depending on the user. Besides, if the user forgets to re-lock the safety lock after ignition, the safety lock will not be functioned.

Moreover, the lighter having a safety lock cannot stop children from the usage of the lighter for a period of time since children will figure out how to switch the lock and ignite the lighter. So, the solution for preventing under age children from the usage of the lighter is to limit their physical capability. It means a safety apparatus is added in the barbecue lighter that provide a resistance effect to under age children who do not have enough physical strength to depress the ignition trigger.

SUMMARY OF THE PRESENT INVENTION

The main object of the present invention is to provide a safety apparatus of a barbecue lighter for preventing under age children from the usage of barbecue lighter.

Another object of the present invention is to provide a safety apparatus of a barbecue lighter wherein the safety apparatus can stop under age children from the usage of barbecue lighter by limitation of their physical capability.

Another object of the present invention is to provide a safety apparatus of a barbecue lighter wherein the ignition of the barbecue lighter of the present invention requires a simple single-action operation by an adult's finger instead of the conventional double-action operation.

Another object of the present invention is to provide a safety apparatus of a barbecue lighter wherein the safety apparatus does not require to alter original structural design of the barbecue lighter, so as to minimize the manufacturing cost of incorporating the safety apparatus with every conventional barbecue lighter having a ignition trigger.

Accordingly, in order to accomplish the above objects, the present invention provides a barbecue lighter which comprises:

a casing having a liquefied gas cavity and a trigger cavity provided therein;

a gas emitting nozzle extended from and communicated with the liquefied gas cavity in the casing;

an elongated nozzle tube mounting on the ceiling of the casing for encircling the gas emitting nozzle;

a piezoelectric unit, which is disposed in the trigger cavity of the casing, having an igniting tip extended adjacent to the gas emitting nozzle;

an ignition trigger, which is disposed in the trigger cavity of the casing in a vertically movable manner, being attached on a top portion of the piezoelectric unit; and a safety apparatus, which comprises:

a pressure absorbing device disposed in the trigger cavity of the casing;

a holding means integrally affixed to an interior surface of the ignition trigger for rigidly holding one end of the pressure absorbing device in position; and a receiving means provided in the trigger cavity for receiving and supporting another end of the pressure absorbing device in position;

thereby, the pressure absorbing device is vertically held between the ignition trigger and a ceiling of the liquefied gas cavity for urging the ignition trigger at an upper normal position thereof and providing an additional press resistance to the ignition trigger, so as to resist a downwardly pressing force applied by an under age child on the ignition trigger while an adult is capable of pushing down the ignition trigger easily.

In other words, in order to ignite the barbecue lighter of the present invention, an adult's finger must press the ignition trigger intentionally. The pressure absorbing device resists the depressing force applied on the ignition trigger by an under age child that the under age child has limited physical capability while an adult is capable of pressing the ignition trigger easily.

DETAILED DESCRIPTION OF THE PREFERRED EMBODIMENT

Figure 1:
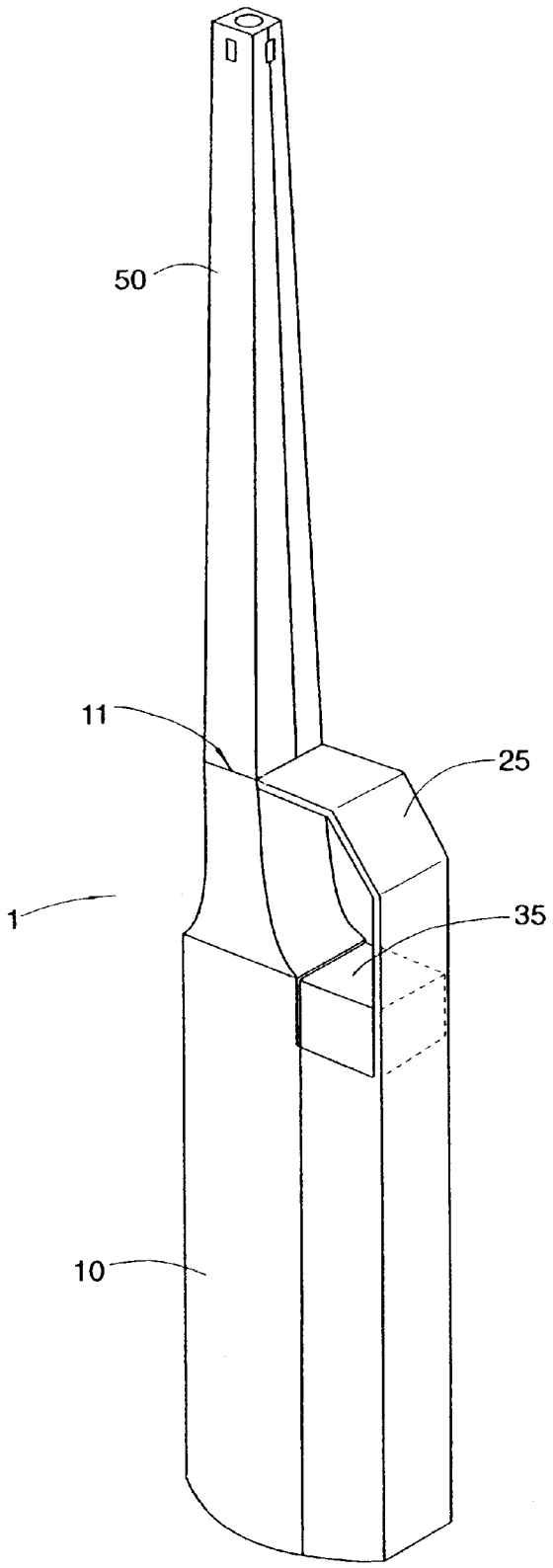
FIG. 1 is a perspective view of a safety apparatus of a barbecue lighter according to a first preferred embodiment of the present invention.
Figure 2:
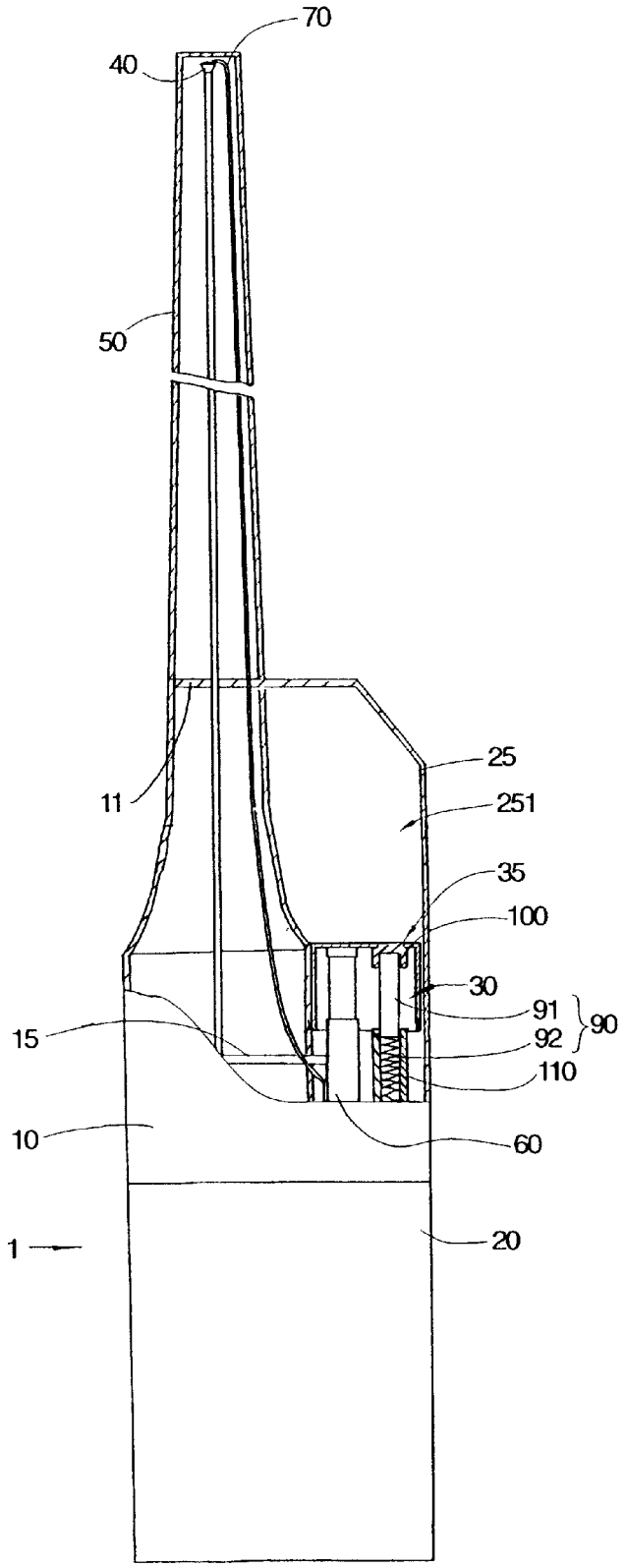
FIG. 2 is a partial sectional view of the safety apparatus of the barbecue lighter according to the above first preferred embodiment of the present invention.

Referring to FIGS. 1 and 2 of the drawings, a barbecue lighter 1 of the present invention is illustrated. The barbecue lighter 1 comprises a casing 10 having a liquefied gas cavity 20 and a trigger cavity 30 provided therein. The barbecue lighter 1 further comprises a gas emitting nozzle 40, an elongated nozzle tube 50, a piezoelectric unit 60, a ginger guide 25, and a safety apparatus 9.

The gas emitting nozzle 40 is upwardly extended from a ceiling 11 of the casing 10 and communicated with the liquefied gas cavity 20. The elongated nozzle tube 50 is mounted on the ceiling 11 of the casing 10 for encircling the gas emitting nozzle 40. The piezoelectric unit 60 is disposed in the trigger cavity 30 of the casing 10 and has an igniting tip 70 extended upwardly until adjacent to the gas emitting nozzle 40. The ignition trigger 35, which is fittedly disposed in the trigger cavity 30 of the casing 10 in a vertically movable manner, is attached on a top portion of the piezoelectric unit 60. The finger guide 25, which is upwardly extended from the outer side of the trigger cavity 30 to the ceiling 11 of the casing, provides a finger cavity 251 therein fitting a user's finger engaged therethrough to press the ignition trigger 35.

The ignition trigger 35 is operatively connected both to the emitting nozzle 40 and to the piezoelectric unit 60 for striking spark in response to a push to the ignition trigger 35. A push-down action of the ignition trigger 35 will downwardly drive and press the piezoelectric unit 60 which will generate striking spark through and out the igniting tip 70 towards the gas emitting nozzle 40. At the mean time, a gas level 15 is simultaneously operated to release gas through the gas emitting nozzle 40 and the releasing gas will be ignited by the striking spark ejected from the ignition tip 70.

Referring to FIG. 2, the safety apparatus 90 of the barbecue lighter 1 according to the present invention is installed inside the trigger cavity 30 of the casing 10, which not only can upwardly urge the ignition trigger 35 at an upper normal position, but also is adapted for increasing the pressure weight of the ignition trigger 35 to a predetermined extent that the under age children are incapable of pushing it down to activate lighting with the barbecue lighter 1 for ensuring safety.

In order to increase the upward urging pressure of the ignition trigger 34, the most simplest way that a person skilled in art would suggest is to fit a strong elastic spring within the trigger cavity 35 to upwardly urge against the ignition trigger 35 so that a child is unable to push down. However, the strengthened spring may also make the adults feel difficult to push down.

Moreover, the cost of a hardened strong spring is much more expensive than a normal resilient spring which is conventionally installed in the trigger cavity 30 for merely propping up the ignition trigger 35, therefore the overall manufacturing cost of the barbecue lighter is unreasonably increased.

In accordance with the present invention, the safety apparatus 90 enables the barbecue lighter 1 to provide a pressing resistance to the ignition trigger 35 for preventing the children from pushing down without the need of incorporating any extra holding means and the increase of manufacturing cost.

The safety apparatus 9 comprises a pressure absorbing device 90 disposed in the trigger cavity 30 of the casing 10 of the barbecue lighter 1, a holding means 100 integrally affixed to an interior surface of the ignition trigger 35 for rigidly holding one end of the pressure absorbing device 90 in position, and a receiving means 110 provided in the trigger cavity 30 for receiving and supporting another end of the pressure absorbing device 90 in position, so that the pressure absorbing device 90 is vertically urged against the ignition trigger 35 at its upper normal position and providing an additional press resistance to the ignition trigger 35, so as to resist the downwardly pressing force applied by an under age child while an adult can push down the ignition trigger 35 easily.

According to the first preferred embodiment of the present invention, the pressure absorbing device 90 comprises a resistance unit 91 and a resilient element 92. The resistance unit 91 is disposed in the trigger cavity 30 of the casing 10, wherein the resistance unit 91 is deformable and will restore automatically to its original shape. The resistance unit 91, which is a cylindrical rubber post, will provide an additional upward urging pressure of the ignition trigger 35. The resilient element 92 is an elastic spring, is coaxially attached to the resistance unit 91 for urging and supporting the ignition trigger 35 in its upper normal position, as shown in FIG. 2.

According to the first preferred embodiment, the holding means 100 is a holding ring downwardly protruded from a bottom surface of the ignition trigger 35 and adapted for holding a top end of the resistance unit 91 in position. The receiving means 110 is a tubular receiving guider upwardly extended from a ceiling of the liquefied gas cavity 20 within the ignition trigger 30, wherein the resilient element 92 and a bottom end of the resistance unit 91 are adapted for inserting into the receiving means 92. The length of the resistance unit 91 is longer than the distance between the holding means 100 and the receiving means 110 in order to achieve the guiding effect for the resistance unit 91. So, the top end of the resistance unit 91 is inserted into the holding means 100 while the bottom thereof is inserted into the receiving means 110 and pressed on the resilient element 92 so as to vertically hold the resistance unit 91 in position. In other words, the resilient element 92 provides a resilient force urging upwardly against the resistance unit 91 and the ignition trigger 35, so as to retain the ignition trigger 35 in its upper normal position, as shown in FIG. 2.

An inner diameter of the holding means 100 is equal to or slightly smaller than an outer diameter of the top end of the resistance unit 91, so that the top end of the deformable resistance unit 91 can be fittedly inserted into the holding means 100. For enhancing connection of the holding means 100 and the top end of the deformable resistance unit 91, the top end of the resistance unit 91 can be further glued to the holding means 100.

Figure 3:
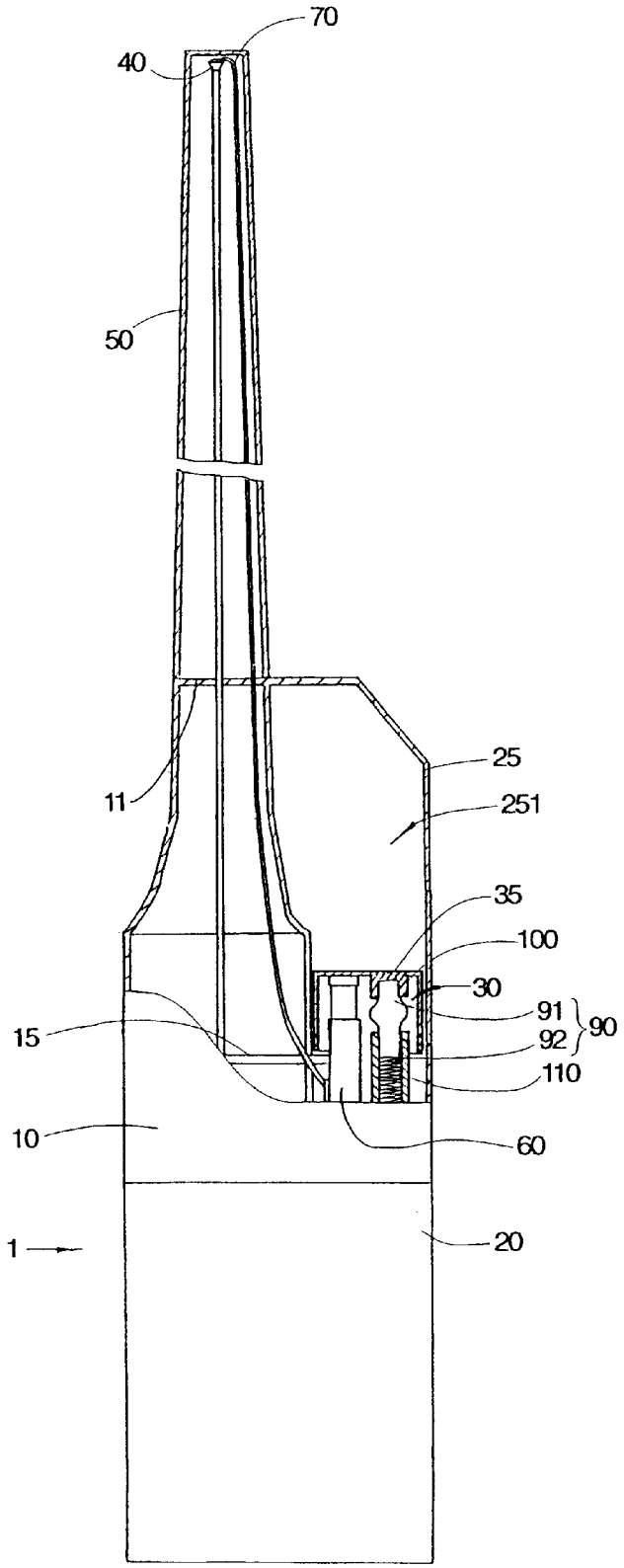
FIG. 3 is a partial sectional view of the safety apparatus of the barbecue lighter according to the above first preferred embodiment of the present invention, illustrating the thumb-push in igniting position.

In order to ignite the barbecue lighter 1, a user's finger must engage through the finger guide 25 and depress the ignition trigger 35 in order to actuate the piezoelectric unit 60 and the gas emitting tip 40 to provide lighting flame. When the ignition trigger 35 is pressed downwardly to a lower ignition position, as shown in FIG. 3, the resilient element 92 will first be compressed inside the receiving means 110 by the downwardly moving resistance unit 91 to lower to its maximum contraction which will cause a stopping force for the deformable resistance unit 91, and then the resistance unit 91 will start to be compressed to deform by increasing its diameter due to the downward pressure applied by the user's thumb. Practically, the resistance unit 91 is compressible through deformation when a predetermined amount of pressure is pressed thereon, so that the deformable resistance unit 91 provides a resistance effect to the under age children who do not have enough physical strength to compress the deformable resistance unit 91. In other words, the under age children do not have sufficient physical strength to deform the resistance unit 91 and compress the resilient element 92 together for igniting purpose. However, an adult has sufficient power to depress the ignition trigger 35 and easily drive the resistance unit 91 to be deformed in order to compress the piezoelectric unit 60 for generating striking spark.

When the depressing force applied on the ignition trigger 35 is released, the compressed resilient element 92 will rebound and urge and retain the ignition trigger 35 from the lower ignition position to the upper normal position, as shown in FIG. 2. Simultaneously, the deformed resistance unit 91 will also restore to its original shape. Furthermore, the both holding means 100 and the receiving means 110 will provide an essential guiding effect of the resistance unit 91 in a vertically movable manner.

Figure 4:
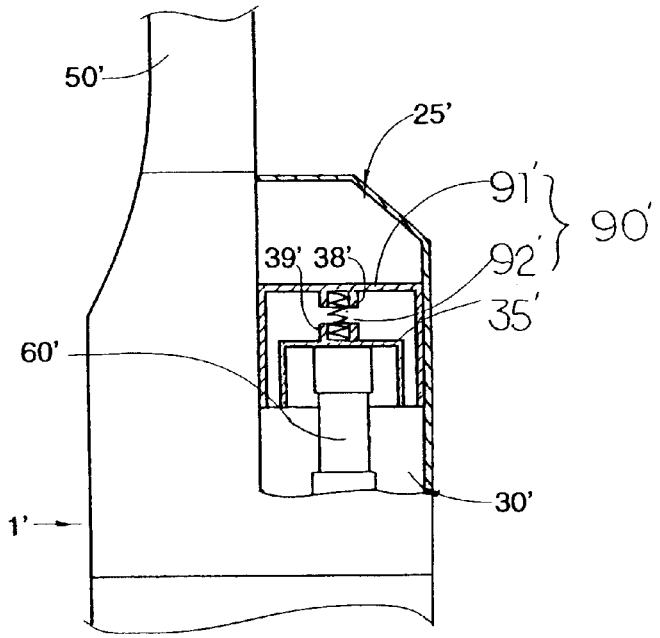
FIG. 4 is a partial sectional view of a safety apparatus of the barbecue lighter according to a second preferred embodiment of the present invention.

Referring to FIG. 4, a second preferred embodiment of the barbecue lighter 1' is illustrated, wherein the pressure absorbing device 90' comprises a cap 91' and an elastic element 92'. The cap 91', which has a larger size than the ignition trigger 35', fully covers the ignition trigger 35' and is sildably mounted on the trigger cavity 30'. The elastic element 92', which is a spring, is affixed between the cap 91' and the ignition trigger 35' and has two ends biasing against the cap 91' and the ignition trigger 35'. The elastic element 92' will normally urge and retain the cap 91' in an upper position. Furthermore, two ends of the elastic element 92' is held by a top holder 38' and a bottom holder 39' respectively, wherein the top holder 38' is downwardly protruded on a bottom surface of the cap 91' and the bottom holder 39' is upwardly protruded on a top surface of the ignition trigger 35'. Since the ignition trigger 35' is entirely encased by the cap 91', the exterior appearance of the barbecue lighter 1' looks like there is only one ignition trigger.

To ignite the barbecue lighter 1', the cap 91' must be depressed and the elastic element 92' will then be compressed first. The user must keep forcing the cap 91'downwardly to depress the ignition trigger 35' in order to compress the piezoelectric unit 60' for generating striking spark. When under age child depress the cap 91' and compress the elastic element 92', they think the barbecue lighter should be fully operated for ignition. However, it does not. The cap 91' and the elastic element 92' will trick the under age child to falsely ignite the barbecue lighter 1'. Moreover, even the under age child figure out the trick, he or his still has no sufficient power to press down the cap 91' and compress the elastic element 92' of the pressure absorbing device 90' of the barbecue lighter 1'.

Figure 5:
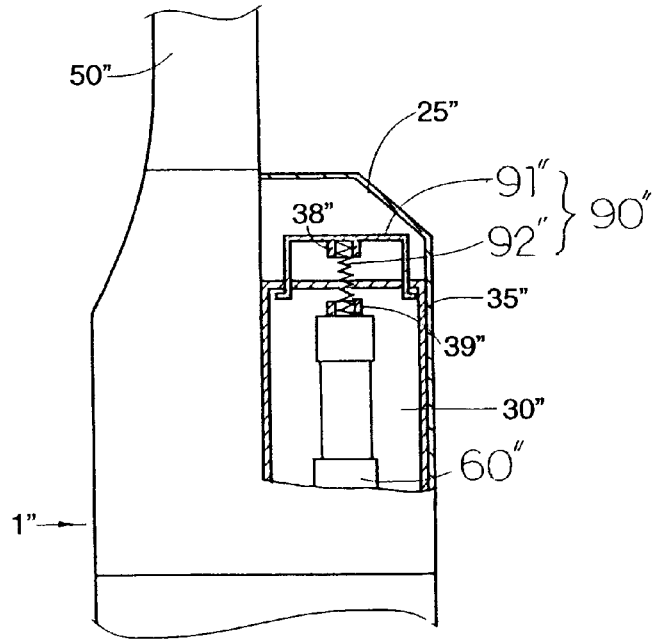
FIG. 5 is a partial sectional view of a safety apparatus of the barbecue lighter according to a third preferred embodiment of the present invention.

Referring to FIG. 5, a third preferred embodiment of the barbecue lighter 1" is illustrated, which has similar configuration as the above second embodiment. The pressure absorbing device 90" of the barbecue lighter 1" comprises a tricky button 91" and an elastic element 92". The tricky button 91" having a smaller size than the ignition trigger 35" is slidably mounted on top of the ignition trigger 35". The elastic element 92" is a spring positioned through the ignition trigger 35" and is affixed between the tricky button 91" and a top end of the piezoelectric unit 60" within the trigger cavity 30". The elastic element 92" having two ends biasing against the tricky button 91" and the top end of the piezoelectric unit 60" will normally urge and retain the tricky button 91" in an upper position. Furthermore, two ends of the elastic element 92" is held by a top holder 38" and a bottom holder 39" respectively, wherein the top holder 38" is downwardly protruded on a bottom surface of the tricky button 36" and the bottom holder 39" is upwardly protruded from the top end of the piezoelectric unit 60".

To ignite the barbecue lighter 1", the user's finger must depress the tricky button 91" and compress the elastic element 92". The user must keep forcing the tricky button 91" downward until the ignition trigger 35" is depressed in order to compress the piezoelectric unit 60" for ignition. The tricky button 91" and the elastic element 92" will trick under age child to operate the tricky button 91" instead of the ignition trigger 35" and mislead he or her to falsely ignite the lighter.

According to the preferred embodiments as disclosed above, the barbecue lighter 1 of the present invention can prevent under age children from the usage of the lighter by limitation of their physical capability and avoid the unintentionally and accidentally ignition of the barbecue lighter from, adults. Since the safety apparatus does not require altering the original structural design of the barbecue lighter, the manufacturing cost of incorporating the safety apparatus is relatively inexpensive. Furthermore, the cost of the assembly operation which is the pressure absorbing device is inexpensive and the installation of the pressure absorbing device is simply and easy. So, the present invention not only provides a safety apparatus but also is in low manufacturing cost.

What is claimed is:

1. A barbecue lighter, comprising:

a casing having a liquefied gas cavity and a trigger cavity provided therein;

a gas emitting nozzle extended from and communicated with said liquefied gas cavity in said casing;

an elongated nozzle tube mounting on a ceiling of said casing for encircling said gas emitting nozzle;

a piezoelectric unit, which is disposed in said trigger cavity of said casing, having an igniting tip extended adjacent to said gas emitting nozzle;

an ignition trigger, which is disposed in said trigger cavity of said casing in a vertically movable manner, being attached on a top portion of said piezoelectric unit; and a safety apparatus, which comprises a pressure absorbing device disposed in said trigger cavity of said casing, a holding means integrally affixed to an interior surface of said ignition trigger for rigidly holding one end of said pressure absorbing device in position, and a receiving means provided in said trigger cavity for receiving and supporting another end of said pressure absorbing device in position, wherein said pressure absorbing device is vertically held for urging said ignition trigger at an upper normal position thereof and providing a press resistance to said ignition trigger, wherein said press resistance is an additional force added to said ignition trigger in addition to that provided by said piezoelectric unit adapted for resisting a downwardly pressing force applied by an under age child on said ignition trigger while an adult is capable of pushing down said ignition trigger easily.

2. A barbecue lighter, as recited in claim 1, wherein said pressure absorbing device comprises:

a resistance unit disposed in said trigger cavity of said casing, wherein said resistance unit is deformable when a compressing force is applied and capable of restoring automatically to an original shape thereof when said compressing force is released, so as to provide an additional upward urging pressure of said ignition trigger; and a resilient element coaxially attached to said the resistance unit for urging and supporting said ignition trigger in said upper normal position.

3. A barbecue lighter, as recited in claim 2, wherein said resilient element having two ends biased against said resistance unit and a ceiling of said liquefied gas cavity.

4. A barbecue lighter, as recited in claim 3, wherein said resistance unit is a rubber post and said resilient element is an elastic spring.

5. A barbecue lighter, as recited in claim 2, wherein said holding means comprises a holding ring integrally protruded from a bottom surface of said ignition trigger and adapted for holding a top end of said resistance unit in position.

6. A barbecue lighter, as recited in claim 4, wherein said holding means comprises a holding ring integrally protruded from a bottom surface of said ignition trigger and adapted for holding a top end of said resistance unit in position.

7. A barbecue lighter, as recited in claim 3, wherein said receiving means is a tubular receiving guider upwardly extended from said ceiling of said liquefied gas cavity within said ignition trigger, wherein said resilient element and a bottom end of said resistance unit are adapted for inserting into said receiving means.

8. A barbecue lighter, as recited in claim 5, wherein said receiving means is a tubular receiving guider upwardly extended from said ceiling of said liquefied gas cavity within said ignition trigger, wherein said resilient element and a bottom end of said resistance unit are adapted for inserting into said receiving means, wherein a length of said resistance unit is longer than said distance between said holding means and said receiving means in order to achieve a guiding effect for said resistance unit, so that said top end of said resistance unit is inserted into said holding means while said bottom thereof is inserted into said receiving means and pressed on said resilient element so as to vertically hold said resistance unit in position.

9. A barbecue lighter, as recited in claim 6, wherein said receiving means is a tubular receiving guider upwardly extended from said ceiling of said liquefied gas cavity within said ignition trigger, wherein said resilient element and a bottom end of said resistance unit are adapted for inserting into said receiving means, wherein a length of said resistance unit is longer than said distance between said holding means and said receiving means in order to achieve a guiding effect for said resistance unit, so that said top end of said resistance unit is inserted into said holding means while said bottom thereof is inserted into said receiving means and pressed on said resilient element so as to vertically hold said resistance unit in position.

10. A barbecue lighter, as recited in claim 8, wherein said top end of said resistance unit is further glued to said holding means.

11. A barbecue lighter, as recited in claim 9, wherein said top end of said resistance unit is further glued to said holding means.

12. A barbecue lighter, comprising:

a casing having a liquefied gas cavity and a trigger cavity provided therein;

a gas emitting nozzle extended from and communicated with said liquefied gas cavity in said casing;

an elongated nozzle tube mounting on a ceiling of said casing for encircling said gas emitting nozzle;

a piezoelectric unit, which is disposed in said trigger cavity of said casing, having an igniting tip extended adjacent to said gas emitting nozzle;

an ignition trigger, which is disposed in said trigger cavity of said casing in a vertically movable manner, being attached on a top portion of said piezoelectric unit; and a safety apparatus comprising a pressure absorbing device disposed in said trigger cavity of said casing, wherein said pressure absorbing device comprises a cap and an elastic element, said cap having a larger size than said ignition trigger to fully cover said ignition trigger and sildably mount on said trigger cavity, said elastic element affixed between said cap and said ignition trigger and having two ends biasing against said cap and said ignition trigger, so as to enable said elastic element normally urging and retaining said cap in an upper position.

13. A barbecue lighter, as recited in claim 12, wherein two ends of said elastic element are held by a top holder and a bottom holder respectively, wherein said top holder is downwardly protruded on a bottom surface of said cap and said bottom holder is upwardly protruded on a top surface of said ignition trigger.

14. A barbecue lighter, comprising:

a casing having a liquefied gas cavity and a trigger cavity provided therein;

a gas emitting nozzle extended from and communicated with said liquefied gas cavity in said casing;

an elongated nozzle tube mounting on a ceiling of said casing for encircling said gas emitting nozzle;

a piezoelectric unit, which is disposed in said trigger cavity of said casing, having an igniting tip extended adjacent to said gas emitting nozzle;

an ignition trigger, which is disposed in said trigger cavity of said casing in a vertically movable manner, being attached on a top portion of said piezoelectric unit; and a safety apparatus comprising a pressure absorbing device disposed in said trigger cavity of said casing, wherein said pressure absorbing device comprises a tricky button which has a smaller size than said ignition trigger and is slidably mounted on top of said ignition trigger, and an elastic element which is a spring positioned through said ignition trigger and is affixed between said tricky button and a top end of said piezoelectric unit within said trigger cavity, wherein said elastic element has two ends biasing against said tricky button and said top end of said piezoelectric unit so as to normally urge and retain said tricky button in an upper position.

15. A barbecue lighter, as recited in claim 14, wherein two ends of said elastic element are held by a top holder and a bottom holder respectively, wherein said top holder is downwardly protruded on a bottom surface of said tricky button and said bottom holder is upwardly protruded from said top end of said piezoelectric unit.

* * * * *